US010610453B2

(12) United States Patent
Byeon

(10) Patent No.: US 10,610,453 B2
(45) Date of Patent: Apr. 7, 2020

(54) MEDICATION ADMINISTRATION DEVICE

(71) Applicant: Jae Seon Byeon, Seoul (KR)

(72) Inventor: Jae Seon Byeon, Seoul (KR)

( * ) Notice: Subject to any disclaimer, the term of this patent is extended or adjusted under 35 U.S.C. 154(b) by 104 days.

(21) Appl. No.: 15/706,939

(22) Filed: Sep. 18, 2017

(65) Prior Publication Data

US 2018/0110681 A1 Apr. 26, 2018

(30) Foreign Application Priority Data

Oct. 25, 2016 (KR) ..... 10-2016-0139207

(51) Int. Cl.
*A61J 7/00* (2006.01)
*A61J 17/00* (2006.01)
*A61J 11/00* (2006.01)

(52) U.S. Cl.
CPC ..... *A61J 7/0015* (2013.01); *A61J 7/0053* (2013.01); *A61J 11/0005* (2013.01); *A61J 17/006* (2015.05)

(58) Field of Classification Search
CPC . A61C 5/62; A61M 5/31576; A61M 5/31583; A61M 5/31586; A61M 5/178; A61M 5/31511; A61J 17/006; A61J 13/00; A61J 11/0005; A61J 11/002; A61J 11/0035; A61J 11/0065; A61G 2005/0858; A61G 2005/0841; A61G 2005/0808
See application file for complete search history.

(56) References Cited

U.S. PATENT DOCUMENTS 2,889,829 A * 6/1959 Tannenbaum ..... A61J 17/006 606/236
2003/0181871 A1* 9/2003 Wilkinson ..... A61M 5/178 604/263
2016/0213570 A1* 7/2016 Athanassiou ..... A61J 7/0053

FOREIGN PATENT DOCUMENTS

KR 20-1989-0008454 5/1989
KR 20-0240767 9/2001
KR 10-2005-0093743 9/2005
KR 10-2013-0115542 10/2013
KR 10-1373476 3/2014

OTHER PUBLICATIONS

English Abstract of 20-1989-0008454, (1989).
English Specification of 10-2013-0115542, (2012).
English Specification of 10-2005-0093743, (2005).
English Specification of 10-1373476, (2012).
English Specification of 20-0240767, (2001).

* cited by examiner

*Primary Examiner* — Bhisma Mehta
*Assistant Examiner* — Nidah M Hussain

(57) ABSTRACT

According to an embodiment of the present disclosure, a medication administration device may comprise a sucking part having outlets, a cylinder part having a discharge hole, coupled with the sucking part, and containing a medication, a piston part discharging the medication from the cylinder part through the outlets, and an operating part operating the piston part in the cylinder part. The discharge hole may extend to the outlets.

6 Claims, 5 Drawing Sheets

MEDICATION ADMINISTRATION DEVICE

CROSS-REFERENCE TO RELATED APPLICATIONS

This patent application claims priority under 35 U.S.C. § 119 to Korean Patent Application No. 10-2016-0139207, filed on Oct. 25, 2016, in the Korean Intellectual Property Office, the disclosure of which is incorporated by reference herein in its entirety.

TECHNICAL FIELD

The present disclosure relates to medication administration devices, and more particularly, to a medication administration device or tool intended for infants.

DISCUSSION OF RELATED ART

Getting kids to take their medicine is sometimes a quite tricky task, especially when they are too young to be willing to do. Infants turn their head to push away the medicine when their parent attempt to give them the medicine. A common way to administer medicine is to use a spoon or syringe.

Another issue with administration of medicine arises when it is not easy to take an exact dose of medication as prescribed.

Some approaches have been proposed to address such issues. However, none of them are enough to present satisfactory results.

SUMMARY

According to an embodiment of the present disclosure, a medication administration device may comprise a sucking part having outlets, a cylinder part having a discharge hole, coupled with the sucking part, and containing a medication, wherein the discharge hole extends to the outlets, a piston part discharging the medication from the cylinder part through the outlets, and an operating part operating the piston part in the cylinder part.

According to an embodiment of the present disclosure, the operating part may include a lever configured to be grabbed and turned from the cylinder part and a connector connecting the piston part with the lever and transformed when an external force is applied to the connector, and wherein when the lever is turned, the connector pushes or pulls the piston part.

According to an embodiment of the present disclosure, the medication administration device may further comprise a locking part provided between the sucking part and the cylinder part to prevent the cylinder part from escaping off the sucking part.

According to an embodiment of the present disclosure, the medication administration device may further comprise a guiding part for guiding the connector to the cylinder part.

According to an embodiment of the present disclosure, the medication administration device may further comprise comprising an anti-leak part provided between the sucking part and the cylinder part to prevent the medication from leaking between the cylinder part and the sucking part, wherein the anti-leak part includes a through hole connecting the outlets with the discharge hole.

According to an embodiment of the present disclosure, the anti-leak part may be bent when an external force is applied thereto, and the anti-leak part may be recovered when the external force is removed.

According to an embodiment of the present disclosure, the anti-leak part may further include at least one wing for easier removal of the anti-leak part.

According to an embodiment of the present disclosure, the medication administration device may further comprise a shock-absorbing part provided at, at least, one of an outer side of the cylinder part or a portion of the lever to protect a user's finger.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF EXEMPLARY EMBODIMENTS

Hereinafter, exemplary embodiments of the present disclosure will be described in detail with reference to the accompanying drawings. The same reference denotations may be used to refer to the same or similar elements throughout the specification and the drawings. The present disclosure, however, may be modified in various different ways, and should not be construed as limited to the embodiments set forth herein. As used herein, the singular forms "a," "an," and "the" are intended to include the plural forms as well, unless the context clearly indicates otherwise. It will be understood that when an element or layer is referred to as being "on," "connected to," "coupled to," or "adjacent to" another element or layer, it can be directly on, connected, coupled, or adjacent to the other element or layer, or intervening elements or layers may be present.

Figure 1:
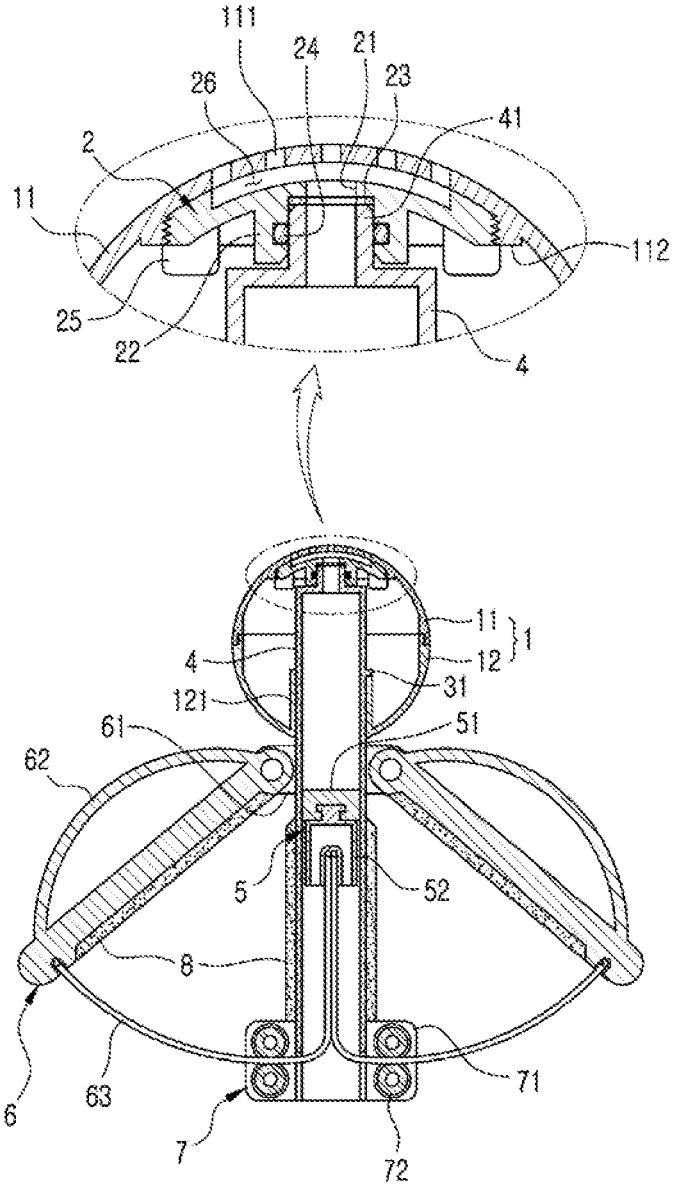
FIG. 1 is a front cross-sectional view illustrating a medication administration device according to an embodiment of the present disclosure.
Figure 2:
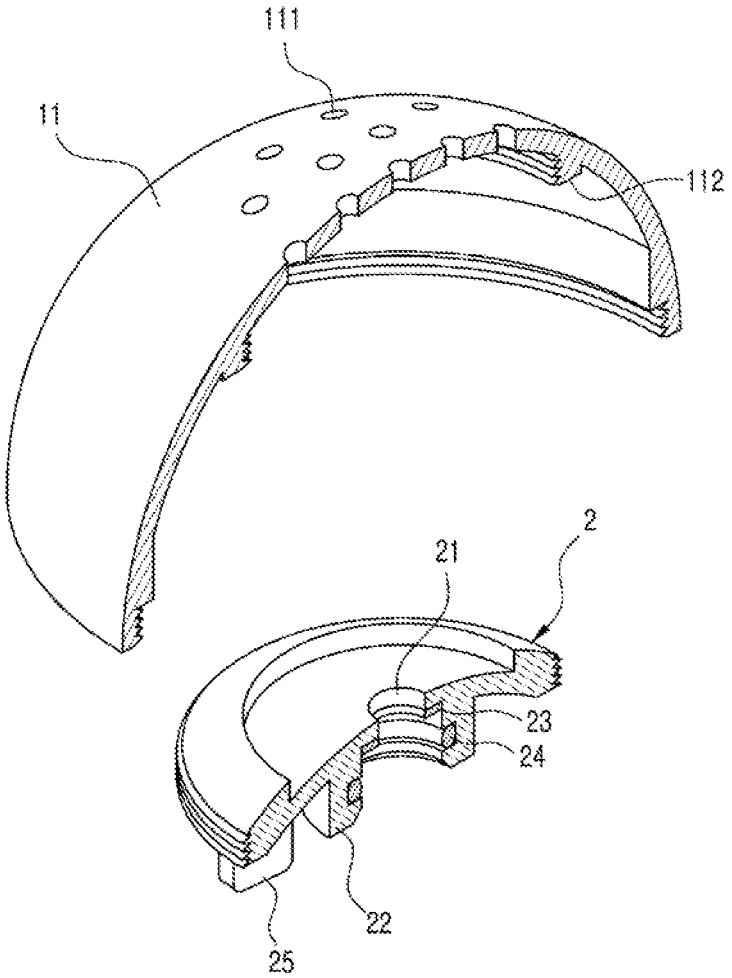
FIG. 2 is an exploded perspective view illustrating an upper body and an anti-leak part of a medication administration device according to an embodiment of the present disclosure.
Figure 3:
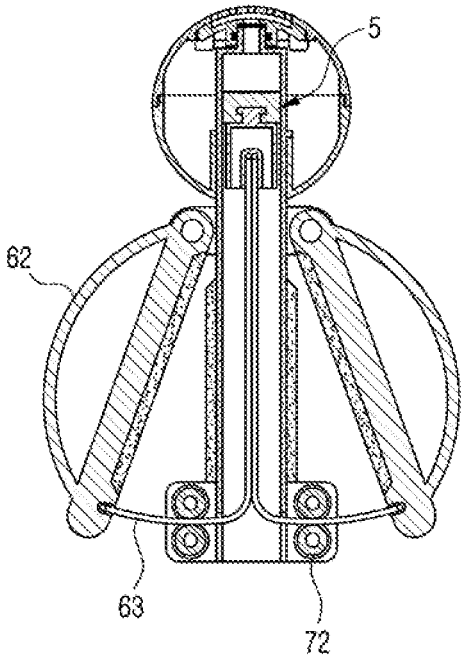
FIG. 3 is a front cross-sectional view illustrating a medication administration device to show how the medication administration device operates according to an embodiment of the present disclosure.

FIG. 1 is a front cross-sectional view illustrating a medication administration device according to an embodiment of the present disclosure. FIG. 2 is an exploded perspective view illustrating an upper body and an anti-leak part of a medication administration device according to an embodiment of the present disclosure. FIG. 3 is a front cross-sectional view illustrating a medication administration device to show how the medication administration device operates according to an embodiment of the present disclosure.

Figure 4:
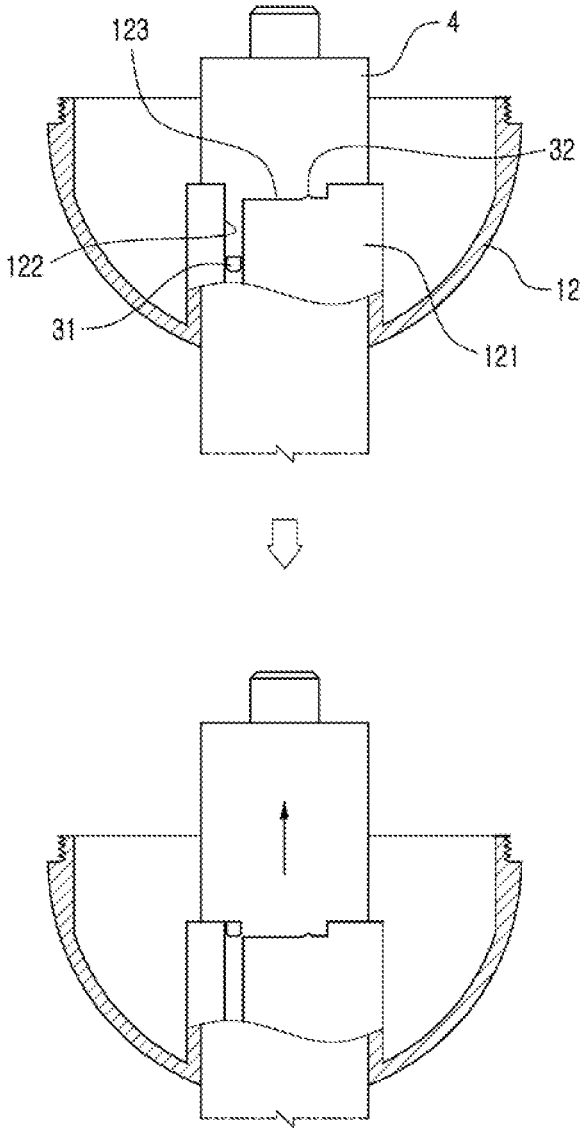
FIGS. 4 and 5 are cross-sectional views illustrating a process in which a lower body and a cylinder part of a medication administration device are coupled together according to an embodiment of the present disclosure.
Figure 5:
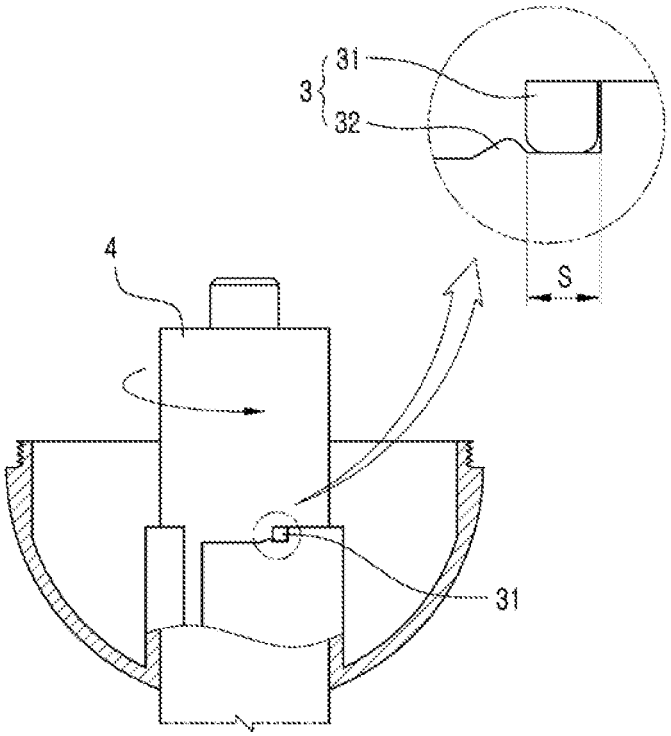

FIGS. 4 and 5 are cross-sectional views illustrating a process in which a lower body and a cylinder part of a medication administration device are coupled together according to an embodiment of the present disclosure.

Referring to FIGS. 1 to 5, a medication administration device, according to an embodiment of the present disclosure, may include a sucking part 1, a cylinder part 4, a piston part 5, and an operating part 6. The medication administration device may further include a locking part 3, a guiding part 7, an anti-leak part 2, and a shock-absorbing part 8.

According to an embodiment of the present disclosure, the medication administration device may be intended for babies, infants, toddlers, or children.

A liquid-type or liquid crystal-type medication may be discharged through the sucking part 1. The sucking part 1 includes an upper body 11 and a lower body 12.

According to an embodiment of the present invention, the sucking part 1 may detachably be provided in the medication administration device. For example, the sucking part 1 may be attached or removed from the other parts of the medication administration device, allowing the sucking part 1 itself to be used in other instruments or devices, e.g., independently or separately from the medication administration device.

The upper body 11 has a substantially semi-circular shape with an opening in the bottom. The upper body 11 may be screwed to the lower body 12.

The upper body 11 includes a plurality of outlets 111 that pass through the top part of the upper body 11. The outlets 111 may be formed in a central portion of the upper body 111 and may be arranged radially.

A female screw part 112 is projected from the ceiling of the upper body 11 to fit and fasten the anti-leak part 2.

The lower body 12 has a substantially semi-circular shape with an opening in the top. An insertion part 121 is projected upwards in a middle portion of the bottom of the lower body 12 to have the cylinder part 4 pass therethrough. The lower body 12 is screwed to the upper body 11.

The upper body 11 and the lower body 12 are coupled together, allowing the sucking part 1 to overall look like a ball.

The insertion part 121 is shaped substantially as a cylinder. The inner diameter of the insertion part 121 may correspond to the outer diameter of the cylinder part 4. The insertion part 121 may include a slit 122 formed in a lengthwise direction and a guiding depression 123 in the top of the insertion part 121. The insertion part 121 extends to the slit 122.

The cylinder part 4 may include a discharge hole.

The anti-leak part 2 is shaped substantially as a disc. The anti-leak part 2 includes a depression in the top, a through hole 21 in a central portion of the top pan thereof, and a cylindrical coupling part 22 projected downwards from the bottom to fit and fasten a pipette 41.

The anti-leak part 2 has a male screw in the outer circumference to be screwed to the female screw part 112 of the upper body 11.

As the anti-leak part 2 is coupled to the female screw part 112, an injection space 26 is formed between the upper body 11 and the anti-leak part 2 to connect the outlets 111 with the through hole 21. The injection space 26 may be formed to be about 5 mm to about 2 mm tall to prevent waste of medication.

The anti-leak part 2 may further include a packing 23 in an upper portion inside the coupling part 22 to tightly contact the top of the pipette 41, preventing leakage of medication between the anti-leak part 2 and the pipette 41.

The anti-leak part 2 may further include a seal 24 along the inner surface of the coupling part 22 to tightly contact the outer circumference of the pipette 41, preventing the medication from leaking between the coupling part 22 and the pipette 41.

As such, medication leakage can be blocked primarily by the packing 23 and secondarily by the seal 24. This structure allows for more secure anti-leakage effects.

The anti-leak part 2 has at least two wings 25 projected downwards from the bottom to enable easier separation from the coupling part 22. As the wings 25 are turned manually or by use of a tool, the anti-leak part 2 is turned to be coupled or separated from the coupling part 22 in an easier manner.

The anti-leak part 2 may be formed of an elastic material that may be bent or warped as an external force is applied thereto and be restored to its original shape as the external force is removed.

The locking part 3 may prevent the cylinder part 4 from escaping off the sucking part 1. The locking part 3 may be formed of an elastic material. The locking part 3 includes a protrusion 31 and a locking jaw 32.

The protrusion 31 may be shaped substantially as a rectangular block, e.g., a rectangular parallelepiped. The bottom corners of the protrusion 31 may be rounded, allowing the protrusion 31 to smoothly slide over the locking jaw 32. The protrusion 31 is projected from the outer surface of the cylinder part 4.

The locking jaw 32 may restrict or release the protrusion 31. The locking jaw 32 may be projected in the guiding depression 123 from the top surface of the insertion part 121 and be positioned in the guiding depression 123, spaced apart from a side surface of the insertion part 121.

The locking jaw 32 may be formed substantially in a semi-circular shape or a triangle with a rounded corner in the top for minimized wear and easier slide of the protrusion 31.

The cylinder part 4 is shaped substantially as a cylinder with an opening in the bottom. The pipette 41 is formed in the top portion of the cylinder part 4. The cylinder part 4 is fitted into the insertion part 121 of the lower body 12.

Specifically, the cylinder part 4 is fitted into the insertion part 121, with the upper body 11, the lower body 12, and the anti-leak part 2 assembled together.

In this case, the protrusion 31 formed on the outer surface of the cylinder part 4 is positioned in the slit 122, and the cylinder part 4 is moved upwards.

As the protrusion 31 escapes off the slit 122, the pipette 41 is fitted into the coupling part 22, and the top of the pipette 41 is brought in tight contact with the packing 23.

After the pipette 41 is fitted into the coupling part 22, the cylinder part 4 is turned.

As the cylinder part 4 turns, the protrusion 31 comes in tight contact with the locking jaw 32. When the cylinder part 4 is further forced to be turned, the protrusion 31 is slid over the locking jaw 32. While the protrusion 31 is slid over the locking jaw 32, the pipette 41 pushes the anti-leak part 2, allowing the anti-leak part 2 to be bent to some degree. When the protrusion 31 fully goes over the locking jaw 32 and reaches the opposite side, the anti-leak part 2 is bent back, i.e., returns to its normal shape. Thereafter, the protrusion 31 is stuck in the guiding depression 123 by the side surface of the insertion part 121, stopping the cylinder part 4 from further turning. Thus, the sucking part 1 and the cylinder part 4 may be firmly coupled together.

A top part S of the insertion part 121 between the locking jaw 32 and the side surface of the insertion part 121 may be stopped up to some degree from the depressed top of the insertion part 121. Accordingly, as the protrusion 31 is restricted in the stepped space S, the pipette 41 may be left in more tight contact with the packing 23, and the protrusion 31 may be stuck in the locking jaw 32 to prevent the cylinder part 4 from escaping off the sucking part 1.

The cylinder part 4 may have gradations on the outer surface to allow the user to check the amount of medication to be administered.

The piston part 5 may be inserted inside the cylinder part 4 to administer or discharge a medication. The piston part 5 may include a head 51 formed of, e.g., rubber, and a rod 52 fastened to the bottom of the head 51. The piston part 5 is moved up or down by the operating part 6.

According to an embodiment of the present disclosure, a known cylinder and a known piston may be adopted as the cylinder part 4 and the piston part 5, respectively.

The operating part 6 may operate the piston part 5. The operating part 6 includes a first bracket 61, a lever 62, and a connector 63.

The first bracket 61 restricts the lever 62. Two first brackets 61 each may be provided at a respective corresponding one of both sides of the cylinder part 4. The first brackets 61 may be positioned at a middle portion of the cylinder part 4.

A pair of levers 62 may be provided which are shaped substantially as scissors. Upper parts of the levers 62 are rotatably connected to the first brackets 61.

For example, the levers 62 are unfolded as the user holds and lifts the levers 62 and are folded as he or she lowers the levers 62.

The connector 63 may deliver a dynamic force from the lever 62 to the piston part 5. A pair of connectors 63 may be provided. The connectors 63 may be shaped substantially as straps. The connectors 63 may be formed of an elastic material that is transformed as an external force is applied thereto and is recovered as the external force is removed.

The respective first ends of the connectors 63 may be inserted into the rod 52 to be restricted by the rod 52, and the respective second ends of the connectors 63 may be inserted into lower parts of the levers 62. The connectors 63 may be provided to be rotatable from the levers 62.

Thus, as the levers 62 are unfolded, the connectors 63 pull down the piston part 5, and as the levers 62 are folded, the connectors 63 push up the piston part 5.

A medication may be administered or discharged as the levers 62 are operated as such.

The guiding part 7 guides the connectors 63. The guiding part 7 includes second brackets 71 and rollers 72.

The second brackets 71 restrict the rollers 72. Each of the second brackets 71 is provided at one of both sides of a lower part of the cylinder part 4.

Two pairs of rollers 72 may be provided, which includes a first pair and a second pair. Each pair of rollers 72 may be provided in a corresponding one of the second brackets 71. For example, each pair of rollers 72 are arranged inside the second bracket 71 to be engaged with each other with a corresponding connector 63 positioned therebetween. The connector 63 is restricted between the rollers 72.

Accordingly, as the connector 63 moves, the rollers 72 rotate. The connector 63 is restricted by the rollers 72 and is thus prevented from escaping off the rollers 72. The connector 63 may also be prevented from bending or folding.

The distance between the center of rotation of the lever 62 and the position where the lever 62 is connected to the connector 63 may be larger than the distance between the center of rotation of the lever 62 and the position where the rollers 72 are engaged together. In this case, allowing the connector 63 to bend at an acute angle may lead to the connector 63 being bent externally, but rather than entering the inside of the cylinder part.

In the instant embodiment, however, the angle at which the connector 63 is to be bent through the rollers 72 is formed to be an obtuse angle. Thus, during the course of folding the levers 62, the connector 63 may be prevented from bending and be rather allowed to easily come in the inside of the cylinder part.

The second brackets 71 may be detached from the cylinder part 4. For example, the second brackets 71 may be fitted-and-fastened or screwed to the cylinder part 4.

The piston part 5 may easily be removed from the cylinder part 4 by separating the guiding part 7 from the cylinder part 4. This way leads to easier washing or cleanup of the cylinder part 4 and the piston part 5.

The rollers 72 may be detachably removed from the second brackets 71. The connectors 63 may detachably be removed from the levers 62. Thus, the piston part 5 may easily be removed from the cylinder part 4 by pulling out the connectors 63 after removing the rollers 72 from the second brackets 71 and removing the connectors 63 from the levers 62.

The shock-absorbing part 8 may be provided to protect the user's finger when the finger is stuck between the lever 62 and the cylinder part 4. The shock-absorbing part 8 may be provided at, at least, one of the outer surface of the cylinder pan 4 or the lever 62 that faces the outer surface of the cylinder part 4.

The shock-absorbing part 8 may be formed of a shock-absorbing material, such as silicone or sponge.

Thus, the user's finger may be prevented from injury when stuck between the lever 62 and the cylinder part 4.

Now described is an example of using a medication administration device for an infant according to an embodiment of the present disclosure.

The user folds the levers 62 using his/her hands with the sucking part 1 and the cylinder part 4 separated from each other.

When the levers 62 fold, the connectors 63 come in through the rollers 72 to the inside of the cylinder part 4. In this case, the connectors 63 come in tight contact with each other, advancing the piston part 5.

As the levers 62 are folded with the pipette 41 soaked in the medication, a predetermined amount of the medication is sucked in. In other words, the levers 62 pull up the connectors 63, so that the connectors 63 pull down the piston part 5. At this time, the pressure inside the cylinder part 4 is reduced, pulling the medication in the cylinder part 4.

The cylinder part 4, after filled with a predetermined amount of medication, is inserted into the insertion part 121.

When the pipette 41 is fully fitted into the coupling part 22, the user turns the cylinder part 4 to fasten the cylinder part 4 to the sucking part 1.

Thereafter, as the levers 62 are folded manually, the medication is discharged through the pipette 41 and fills the injection space 26 through the through hole 21.

The medication which fills the injection space 26 is discharged through the outlets 111 to the outside of the sucking part 1, so that the infant may suck or lick the medication.

As the infant sucks in the medication through the sucking part 1, the piston part 5 may slightly be advanced by the sucking force even without turning the levers 62.

As such, the present disclosure allows for self-administration of a medication to an infant without any repulsion.

According to the embodiments of the present disclosure, the medication administration device allows the infant to easily take medicine on his/her own without repulsion. Further, the present disclosure may minimize the remaining medication in the medication administration device, preventing the waste of medication. The medication can be prevented from leaking between the sucking part and the cylinder part. The sucking part and the cylinder part may easily be assembled or disassembled from each other. The sucking part and the anti-leak part may be separated from each other in an easier manner, enabling easier cleanup. According to the present disclosure, the user's finger can be prevented from being stuck and injured.

Although the sucking part 1 is described as being used for a medication administration device according to an embodiment of the present disclosure, embodiments of the present invention are not limited thereto. For example, the sucking part 1 may also be intended for other various devices or instruments, such as a syringe, medicine bottle, or medication dispenser.

While the present disclosure has been shown and described with reference to exemplary embodiments thereof, it will be apparent to those of ordinary skill in the art that various changes in form and detail may be made thereto without departing from the spirit and scope of the present to disclosure as defined by the following claims.

What is claimed is:

1. A medication administration device, comprising:

a sucking part having outlets;

a cylinder part having a discharge hole, coupled with the sucking part, and containing a medication, wherein the discharge hole extends to the outlets;

a piston part discharging the medication from the cylinder part through the outlets;

an operating part operating the piston part in the cylinder part; and an anti-leak part provided between the sucking part and the cylinder part to prevent the medication from leaking between the cylinder part and the sucking part, wherein the anti-leak part includes a through hole connecting the outlets with the discharge hole, wherein the anti-leak part is bent when an external force is applied thereto, and the anti-leak part is recovered when the external force is removed.

2. The medication administration device of claim 1, wherein the operating part includes:

a lever configured to be grabbed and turned from the cylinder part; and a connector connecting the piston part with the lever and transformed when an external force is applied to the connector, and wherein when the lever is turned, the connector pushes or pulls the piston part.

3. The medication administration device of claim 2, further comprising a guiding part for guiding the connector to the cylinder part.

4. The medication administration device of claim 2, further comprising a shock-absorbing part provided at, at least, one of an outer side of the cylinder part or a portion of the lever to protect a user's finger.

5. The medication administration device of claim 1, further comprising a locking part provided between the sucking part and the cylinder part to prevent the cylinder part from escaping off the sucking part.

6. The medication administration device of claim 1, wherein the anti-leak part further includes at least one wing for easier removal of the anti-leak part.

* * * * *